US009682404B1

(12) United States Patent
Geertsen

(10) Patent No.: US 9,682,404 B1
(45) Date of Patent: Jun. 20, 2017

(54) METHOD AND APPARATUS FOR SEPARATING FINE PARTICULATE MATERIAL FROM A MIXTURE OF COARSE PARTICULATE MATERIAL AND FINE PARTICULATE MATERIAL

(71) Applicant: REC Silicon Inc, Moses Lake, WA (US)

(72) Inventor: Robert J. Geertsen, Eltopia, WA (US)

(73) Assignee: REC Silicon Inc, Moses Lake, WA (US)

( * ) Notice: Subject to any disclaimer, the term of this patent is extended or adjusted under 35 U.S.C. 154(b) by 0 days.

(21) Appl. No.: 15/147,859

(22) Filed: May 5, 2016

(51) Int. Cl.

| | |
|---|---|
| ***B07B 4/00*** | (2006.01) |
| ***B07B 1/22*** | (2006.01) |
| ***B07B 4/08*** | (2006.01) |
| ***B07B 11/02*** | (2006.01) |
| ***B07B 11/06*** | (2006.01) |
| ***B07B 4/06*** | (2006.01) |

(52) U.S. Cl.
CPC ..... *B07B 1/22* (2013.01); *B07B 4/06* (2013.01); *B07B 4/08* (2013.01); *B07B 11/02* (2013.01); *B07B 11/06* (2013.01)

(58) Field of Classification Search
CPC .. B07B 4/00; B07B 4/06; B07B 11/02; B07B 11/06; B07B 1/22; B07B 4/08
See application file for complete search history.

(56) References Cited

U.S. PATENT DOCUMENTS

| | | | | |
|---|---|---|---|---|
| 1,673,848 | A * | 6/1928 | Stebbins | B07B 4/06 209/152 |
| 2,389,715 | A | 11/1945 | Beardsley | |
| 2,523,259 | A | 9/1950 | Aber | |
| 3,804,249 | A | 4/1974 | Gibbons et al. | |
| 3,834,530 | A | 9/1974 | Bell | |
| 3,957,629 | A | 5/1976 | Paterson | |
| 3,957,630 | A | 5/1976 | Mooradian | |
| 3,970,547 | A | 7/1976 | Theodore et al. | |
| 4,029,572 | A | 6/1977 | Theodore et al. | |
| 4,039,434 | A | 8/1977 | Croucher | |
| 4,043,901 | A | 8/1977 | Gauld | |
| 4,070,202 | A | 1/1978 | Nollet | |

(Continued)

FOREIGN PATENT DOCUMENTS

| | | |
|---|---|---|
| EP | 0437047 A1 | 7/1991 |
| EP | 1818111 A2 | 8/2007 |

(Continued)

*Primary Examiner* — Mark Beauchaine
(74) *Attorney, Agent, or Firm* — Klarquist Sparkman, LLP

(57) ABSTRACT

Fine particulate material is separated from a mixture of coarse particulate material and fine particulate material by passing sweep gas through the chamber of a rotating tumbler drum that contains an introduced material that is a mixture of coarse particulate material and fine particulate material. In particular, polysilicon powder may be separated from granular polysilicon. Seals are present, at locations where gas-conveying parts of the apparatus move relative to one another, to block the escape of sweep gas to the atmosphere surrounding the apparatus. A downstream seal extends between a stationary exhaust duct and an exhaust tube that rotates with the tumbler drum. The seal is protected by a flow of clean flush gas that is delivered to a gap between the exhaust duct and the exhaust tube.

20 Claims, 5 Drawing Sheets

(56) References Cited

U.S. PATENT DOCUMENTS

| | | | | |
|---|---|---|---|---|
| 4,107,034 | A | 8/1978 | Paterson et al. | |
| 4,178,232 | A | 12/1979 | Nollet | |
| 4,194,633 | A | 3/1980 | Paterson et al. | |
| 4,210,527 | A | 7/1980 | Paterson et al. | |
| 4,278,532 | A | 7/1981 | Birch et al. | |
| 4,479,286 | A | 10/1984 | Brown et al. | |
| 4,549,660 | A | 10/1985 | Werling | |
| 4,634,060 | A | 1/1987 | Riemann et al. | |
| 4,689,143 | A | 8/1987 | Miers | |
| 4,784,840 | A | 11/1988 | Gautreaux et al. | |
| 4,883,687 | A | 11/1989 | Gautreaux et al. | |
| 4,998,675 | A | 3/1991 | Mohrman | |
| 5,022,982 | A | 6/1991 | Greeley | |
| 5,056,924 | A | 10/1991 | Christenson | |
| 5,158,182 | A | 10/1992 | Fischer-Helwig et al. | |
| 5,178,457 | A | 1/1993 | Helmy | |
| 5,195,640 | A | 3/1993 | Seaverns | |
| 5,205,847 | A | 4/1993 | Montieth et al. | |
| 5,242,671 | A | 9/1993 | Allen et al. | |
| 5,405,658 | A | 4/1995 | Ibrahim et al. | |
| 5,593,042 | A * | 1/1997 | Keller | B07B 1/20 209/261 |
| 5,613,279 | A | 3/1997 | Rhyne | |
| 5,762,689 | A | 6/1998 | Hunziker | |
| 5,791,493 | A | 8/1998 | Meyer | |
| 5,855,232 | A | 1/1999 | Oda et al. | |
| 6,110,242 | A | 8/2000 | Young | |
| 6,119,969 | A | 9/2000 | Racine | |
| 7,291,222 | B2 | 11/2007 | Holder et al. | |
| 7,708,828 | B2 | 5/2010 | Weidhaus et al. | |
| 8,075,692 | B2 | 12/2011 | Osborne et al. | |
| 8,800,777 | B2 | 8/2014 | Schneider et al. | |
| 2003/0077128 | A1 | 4/2003 | Williams et al. | |
| 2004/0079234 | A1 * | 4/2004 | Gorbulsky | B01D 46/0035 96/289 |
| 2004/0151652 | A1 | 8/2004 | Herold et al. | |
| 2005/0279277 | A1 | 12/2005 | Holder et al. | |
| 2006/0105105 | A1 | 5/2006 | Ibrahim et al. | |
| 2008/0187481 | A1 | 8/2008 | Ibrahim et al. | |
| 2012/0052297 | A1 | 3/2012 | Pech et al. | |
| 2013/0236367 | A1 | 9/2013 | Bhusarapu et al. | |
| 2013/0295385 | A1 | 11/2013 | Hertlein et al. | |
| 2013/0309524 | A1 | 11/2013 | Vietz et al. | |
| 2014/0262981 | A1 | 9/2014 | Yun et al. | |

FOREIGN PATENT DOCUMENTS

| | | |
|---|---|---|
| WO | WO 2006/007082 | 1/2006 |
| WO | WO 2006/062660 | 6/2006 |

* cited by examiner

METHOD AND APPARATUS FOR SEPARATING FINE PARTICULATE MATERIAL FROM A MIXTURE OF COARSE PARTICULATE MATERIAL AND FINE PARTICULATE MATERIAL

FIELD

This disclosure concerns apparatus and method for separating fine particulate material from a mixture of coarse particulate material and fine particulate material.

BACKGROUND

In many industries there is a need to separate fine particulate material from a mixture of coarse particulate material and fine particulate material.

As a particular example, granular polysilicon as produced, e.g., by a fluid bed reactor, such as the reactor shown in U.S. Pat. No. 8,075,692, typically contains from 0.25% to 3% powder or dust by weight. The powder may render the product unsuitable for certain applications. For example, a product containing such levels of powder typically is unsuitable for use in producing monocrystalline silicon because the powder can cause a loss of structure, making single crystal growth impossible.

Current wet processes for removing dust have disadvantages because there is complex, costly equipment to maintain, significant quantities of water and/or chemicals are required, and the processing may cause detrimental oxidation of the polysilicon. Dry processes may avoid these disadvantages, but because silicon powder is highly abrasive, mechanical equipment used in a dry process is subject early failure due to abrasion of the equipment by contact with the silicon materials, particularly at locations where silicon materials enter into spaces between moving parts of the equipment.

Thus there is a need for improved devices and methods for producing granular polysilicon with reduced dust or powder levels.

SUMMARY

Disclosed herein are devices and methods for separating fine particulate material from a mixture of coarse particulate material and fine particulate material. In particular, devices and methods are described for separating silicon powder from a mixture of polysilicon granules and silicon powder.

One device includes a tumbler drum having a wall that defines a chamber, a gas inlet and an outlet, with the gas inlet and the outlet being at spaced apart locations. The device also includes a source of sweep gas in communication with the gas inlet to provide a flow of gas to the gas inlet. An exhaust tube extends from the wall. The exhaust tube has an inlet that is or coincides with the outlet of the drum. A dust collection assembly is fluidly connected to the outlet, via the exhaust tube and an exhaust duct, to receive separated polysilicon dust. The exhaust duct extends into a central passageway within the exhaust tube such that a gap is located between the exhaust tube and the exhaust duct. The device also includes a source of clean flush gas in communication with the gap to provide a flow of gas to flush the gap with gas and thereby inhibit entry of polysilicon dust into the gap. In some arrangement both the sweep gas and the flush gas are provided from a common gas source. The device further includes a source of motive power operable to rotate the tumbler drum about an axis of rotation that extends longitudinally through the drum chamber. Advantageously the tumbler drum will inlet and outlet tubes that are shaped and positioned to serve as trunnions that are supported by a stand having cradles that support the trunnions for rotation of the drum about the axis of rotation. The device is particularly well suited for separating silicon powder from a mixture of polysilicon granules and silicon powder.

Methods for separating fine particulate material, such as silicon powder, from a mixture of coarse particulate material and fine particulate material, such as a mixture of granular polysilicon and silicon powder, include introducing a particulate material that is a mixture of coarse particulate material and fine particulate material into a tumbler drum; rotating the tumbler drum about the axis of rotation at a rotational speed for a period of time; flowing sweep gas through the drum chamber of the tumbler drum from a gas inlet to an outlet while the tumbler drum is rotating, thereby entraining separated fine particulate material in the sweep gas; and separating the sweep gas and entrained fine particulate material from the other polysilicon material, whereby at least a portion of the fine particulate material is separated from the coarse particulate material. Flush gas is provided to one or more regions where parts of the apparatus move relative to one another, to keep entrained fine particulate material from coming into contact with the parts. Tumbled particulate material is removed from the chamber of the tumbler drum, the tumbled particulate material comprising a reduced percentage by weight of fine particulate material than the introduced particulate material. In some instances, the method further includes collecting the entrained separated fine particulate material at a location external to the tumbler drum.

The foregoing and other features and advantages of the disclosed technology will become more apparent from the following detailed description, which proceeds with reference to the accompanying figures.

DETAILED DESCRIPTION

Figure 1:
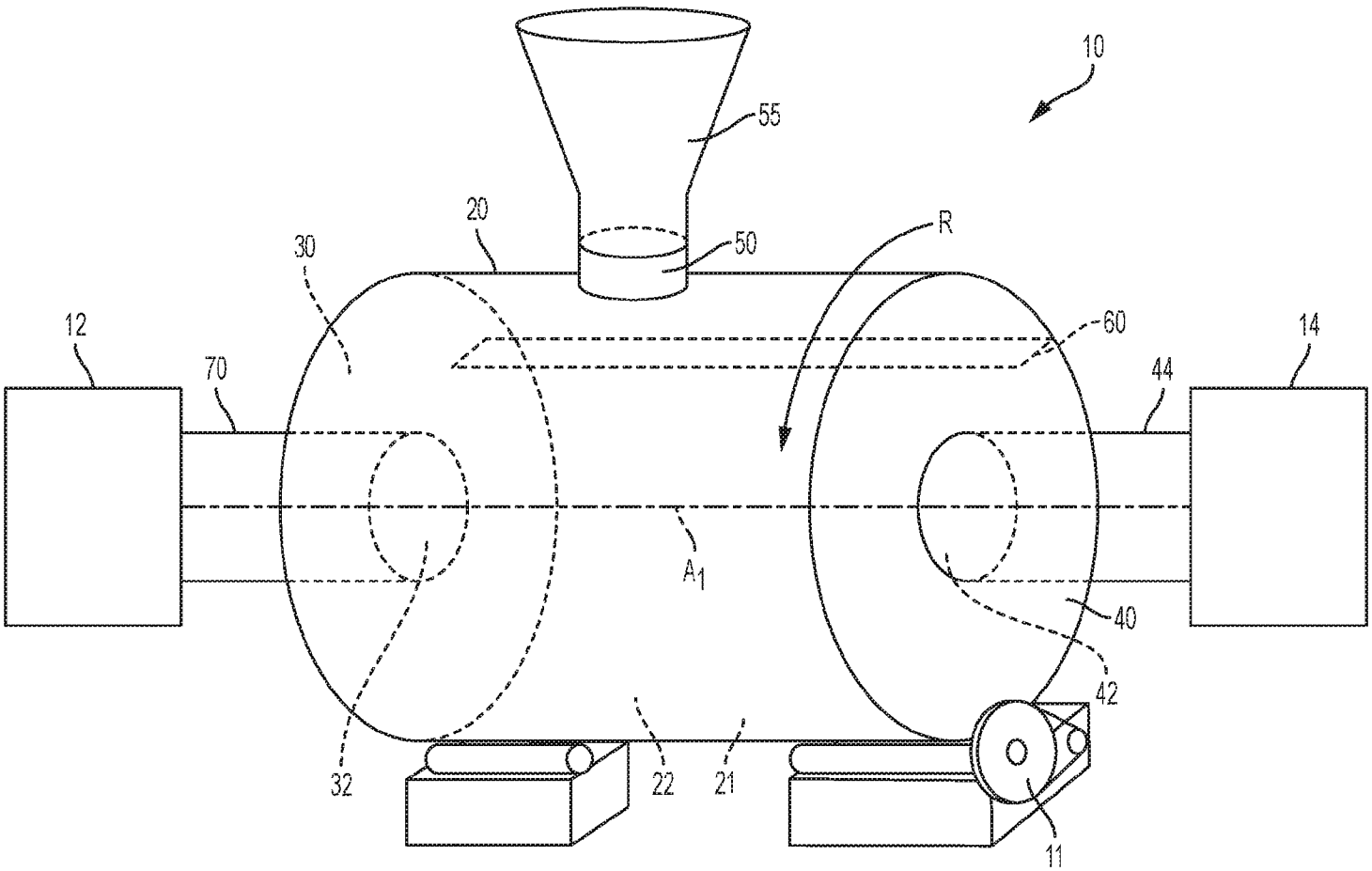
FIG. 1 is a schematic view of a device for separating fine particulate material from a mixture of coarse particulate material and fine particulate material.

Certain industrial processes result in a product that is mixture of coarse particulate material and fine particulate material. For example, granular polysilicon is produced in a fluid bed reactor (FBR) by pyrolysis of a silicon-bearing gas such as monosilane. The conversion of silane to silicon occurs via homogeneous and heterogeneous reactions. The homogeneous reaction produces nano- to micron-sized silicon powder or dust, which will remain in the bed as free powder, attach to polysilicon granules, or elutriate and leave the FBR with effluent hydrogen gas. The heterogeneous reaction forms a solid silicon deposit on available surfaces, which primarily are surfaces of seed material (silicon particles onto which additional polysilicon is deposited), typically having a diameter in the largest dimension of 0.1-0.8 mm, such as 0.2-0.7 mm or 0.2-0.4 mm before deposition. On a microscopic scale, the surface of granular polysilicon produced in a fluid bed reactor has porosity that can trap dust. The surface also has microscopic attached features that can be broken away or otherwise removed when the granules are handled through a process known as attrition.

In the context of this disclosure, the terms "powder" and "dust" are used interchangeably, and refer to particles having an average diameter less than 250 μm. As used herein, "average diameter" means the mathematical average diameter of a plurality of powder or dust particles. When granular polysilicon is produced in a fluidized bed reactor, the average diameter of the powder particles may be considerably smaller than 250 μm, such as an average diameter less than 50 μm. Individual powder particles may have a diameter ranging from 40 nm to 250 μm, and more typically have a diameter ranging from 40 nm to 50 μm, or from 40 nm to 10 μm. Particle diameter can be determined by several methods, including laser diffraction (particles of submicron to millimeter diameter), dynamic image analysis (particles of 30 μm to 30 nm diameter), and/or mechanical screening (particles of 30 μm to more than 30 mm diameter).

The terms "granular material" and "granules" refer to particles having an average diameter of 0.25 to 20 mm, such as an average diameter of 0.25-10, 0.25-5, or 0.25 to 3.5 mm. The term "granular polysilicon" refers to polysilicon particles having an average diameter of 0.25 to 20 mm, such as an average diameter of 0.25-10, 0.25-5, or 0.25 to 3.5 mm. As used herein, "average diameter" means the mathematical average diameter of a plurality of granules. Individual granules may have a diameter ranging from 0.1-30 mm, such as 0.1-20 mm, 0.1-10 mm, 0.1-5 mm, 0.1-3 mm, or 0.2-4 mm.

When silicon is produced in an FBR process from a silicon source gas that is a perhydrosilane (compound or mixture of compounds that consists essentially of silicon and hydrogen), such as monosilane gas, some of the silicon produced typically will be in the form of silicon powder. (Granulate polysilicon produced by an FBR process utilizing a halosilane source gas, such as trichlorosilane, does not typically result in any significant silicon powder accumulation due to a different chemistry inside the reactor.) In particular, when silicon is produced from a perhydrosilane, the product typically is a mixture of silicon materials that includes granular polysilicon and silicon powder, with the silicon powder being from 0.25% to 3% of the mixture by weight; this quantity includes both free and surface-attached powder. The presence of silicon powder in association with the granular polysilicon is undesirable for users who melt and recrystallize the polysilicon in single-crystal growth processes due to the potential to cause loss of structure in the crystal. The powder also creates housekeeping and industrial hygiene difficulties, and potentially a combustible dust hazard at the manufacturing facility.

Devices for dedusting granules may include a tumbler drum. Such devices include gas flow apparatus configured to pass a flow of sweep gas through the tumbler drum to entrain powder and carry the entrained powder out of the drum. The gas flow apparatus includes a gas supply system to deliver sweep gas to the chamber of the tumbler drum and an exhaust system to convey sweep gas and entrained powder away from the chamber of the tumbler drum. Examples of such as devices, which are particularly well-suited for use in separating silicon powder from polysilicon granules, are described in U.S. patent application Ser. No. 14/536,496, filed Nov. 7, 2014, which is incorporated herein by reference in its entirety.

The performance requirements of a dedusting tumbler system are very high when the material to be dedusted is a mixture of high purity silicon granules and silicon powder to be used in electronics or photovoltaic applications. In addition to high levels of dust removal, the system must not contaminate the granular polysilicon product. Sensitive contaminants include metals, carbon, boron, and phosphorous. Ideal metal concentration on the final product is less than 50 parts per billion atoms (ppba), or even more desirably less than 10 ppba. Carbon concentration is desired less than 0.5 ppma. Boron and phosphorous concentrations are desired much less than 1 ppba.

To meet these stringent performance requirements, the materials of construction and the configuration of ventilation seals are very significant. Any wear products generated in the sweep gas supply system, if allowed into the flow of the sweep gas, would be a source of contamination. It can also be a problem that granular polysilicon product enters the exhaust system and spills back into the tumbler drum. The exhaust system therefore is another potential source of contamination. Other potential sources of contamination include packing materials and lubricants, such as grease, used with exhaust system seals.

Silicon has a hardness of 11.9 GPa as measured by nano indentation at a load of 15 mN with indentation depth at peak load 267 nm, which is about 7 on the Mohs scale. That is greater than the hardness of processing equipment in which silicon material is contained during a dedusting process. Such equipment typically is made of steel and may have components made of materials that are even less hard than steel. It is therefore also a problem that silicon powder is abrasive and therefore difficult to convey through a dedusting apparatus, particularly through a tumbler dedusting apparatus having junctions of parts that move relative to one another and along which silicon material is conveyed. Traditional packing style seals fail to adequately perform when exposed to abrasive powder in such apparatus.

One advantageous apparatus for separating granular polysilicon and silicon powder, as shown in FIG. 1, includes a tumbler drum, a stand that supports the tumbler drum for rotation about an axis of rotation, and apparatus for rotating the tumbler drum, e.g., a motor. In particular, the apparatus of FIG. 1 includes a tumbler drum 10 and a source of motive power 11 operable to rotate the tumbler drum. The tumbler drum 10 has a wall that defines a drum chamber 22. In the illustrated apparatus, the wall includes a side wall 20, a first end wall 30 and a second end wall 40.

The tumbler drum has a sweep gas inlet positioned to admit sweep gas into the drum chamber and sweep gas outlet positioned to discharge sweep gas from the drum chamber. In the apparatus of FIG. 1, the first end wall 30 defines a sweep gas inlet 32, and the second end wall 40 defining a sweep gas outlet 42. The illustrated tumbler drum 10 is supported to rotate about an axis of rotation $A_1$ that extends through both the sweep gas inlet 32 and the sweep gas outlet 42.

The side wall 20 of the exemplary tumbler drum 10 is tubular. In particular, each of the inner and outer surfaces of the illustrated side wall 20 is the lateral surface of a cylinder having a substantially constant circular transverse cross-sectional geometry along the longitudinal axis of rotation $A_1$. Other geometries are also contemplated. For example, side wall 20 could have an inner surface 21 that defines a chamber having a boundary that is triangular, square, pentagonal, hexagonal, or higher order polygonal in cross-section. In any of the embodiments, the axis of rotation $A_1$ advantageously may be centered within the chamber 22 as shown in FIG. 1, or the axis of rotation $A_1$ may be off-center.

In one variation (not shown), the side wall, first end wall, and second end wall collectively define the chamber of a v-mixer, e.g., a mixing device having a tumbler drum that defines a mixing chamber generally in the shape of the letter "V" and that is rotatable about a horizontal axis of rotation.

The tumbler drum 10 has a polysilicon inlet to provide access to the drum chamber 22 for introducing the polysilicon material into the drum chamber and for removing the tumbled polysilicon material from the drum chamber. In the exemplary tumbler drum 10 illustrated in FIG. 1, a port 50 extends through the side wall 20. Port 50 may be used to load a polysilicon material that is a mixture of granular polysilicon and silicon powder into the drum chamber 22. Port 50 also may be used to remove tumbled polysilicon material from the drum chamber 22. Port 50 is closed during rotation of the tumbler drum 10. A feed hopper 55 may be removably or fixedly connected to port 50 to facilitate introduction of the polysilicon material into the drum chamber 22 and/or to facilitate removal of granular polysilicon from the drum chamber 22 after tumbling. Alternatively, the feed hopper may be integral with the side wall, e.g., the side wall and hopper are a unitary structure wherein the port extends through the side wall and into the hopper.

As illustrated in FIG. 1, a source of sweep gas 12 is connected to gas inlet 32 to provide a sweep gas flow longitudinally through the drum chamber 22 from the inlet 32 to the outlet 42. Advantageously, as shown in the apparatus of FIG. 1, the region around the axis $A_1$ is unobstructed such that an unobstructed direct sweep gas flow path is provided between the sweep gas inlet 32 and the sweep gas outlet 42 along the axis $A_1$. The sweep gas source 12 includes a gas conveyance device (not shown), such as a blower or pump mechanism and/or a vessel containing a volume of gas stored at an elevated pressure. The gas conveyance device is operable to provide a flow of gas from the sweep gas source 12 to the drum chamber 22. A control device (not shown) is provided to regulate operation of the gas conveyance device and thereby regulate the rate of gas flow from the sweep gas source 12 to the inlet 32. The outlet 42 is positioned permit discharge of sweep gas and entrained silicon powder from the drum chamber 22. A filter (not shown), e.g., a HEPA filter, may be positioned between the sweep gas source 12 and gas inlet 32. The illustrated dedusting apparatus could be operated at a negative pressure, for example by drawing a partial vacuum in the exhaust duct passageway 162 to establish a flow of gas through the apparatus; but operation at an elevated pressure is more efficient and prevents ambient air from being drawn into interior regions of the apparatus that may contain combustible material.

The apparatus may include components (not shown) for introducing water vapor into the chamber 22 of the tumbler drum. In some embodiments, water vapor is introduced into the flow path of the sweep gas at a location between the sweep gas source 12 and gas inlet 32. In embodiments including both a filter and a water introduction apparatus, the components may be arranged with the filter between the sweep gas source 12 and the water introduction apparatus. In other examples, the filter may be positioned between water introduction apparatus and gas inlet 32.

The apparatus shown in FIG. 1 includes a dust collection assembly 14, including a blower, a cyclone and a filter assembly. The dust collection assembly 14 is operably connected to outlet 42 to collect dust removed from the granular polysilicon. In one embodiment (not shown), a recirculation duct is in communication with both the dust collection assembly 14 and the gas inlet 32 so sweep gas that is cleaned of entrained dust in dust collection assembly can be recirculated from the dust collection assembly to the gas inlet. In one embodiment, longitudinal axis $A_1$ is horizontal. In another embodiment, longitudinal axis $A_1$ is tilted such that outlet 42 is lower than inlet 32. Longitudinal axis $A_1$ may be tilted at an angle of up to 30 degrees from horizontal.

In some embodiments, the tumbler drum 10 includes one or more lifting vanes 60 (such as from 1-40, 1-20, 5-15, or 10-12 lifting vanes), for example attached to and extending inward from side wall 20. Geometries and arrangements of lifting vanes are described in U.S. patent application Ser. No. 14/536,496.

In one exemplary arrangement, a tumbler drum 10 has a capacity of 1000-2000 kg polysilicon. The drum chamber 22 is partially defined by tumbler side wall 20 that has an inner surface that is a cylinder of circular cross-section with a uniform diameter of 150-200 cm and a length of 100-130 cm. The tumbler drum includes 1 to 20 lifting vanes 60, such as from 5-15 or 10-12 lifting vanes. If present, each lifting vane may have a height from 7.5 cm to 40 cm, such as from 15-30 cm. The tumbler drum also may include a plurality of intermediate supports (not shown). The tumbler drum 10 may be filled with a mixture of granular polysilicon and silicon powder to a depth that does not obstruct the gas inlet 32 and/or outlet 42. Thus, the tumbler drum may be filled to a depth of 50-80 cm with the mixture. In this arrangement, the tumbler drum may be operable to rotate at 5-30 rpm.

The specific apparatus shown in FIG. 1 includes an exhaust tube assembly 44 having a tubular wall that may have a cylindrical configuration. Desirably, the tubular wall of the exhaust tube assembly 44 has a circular cross-section. In the apparatus shown in FIG. 1, the drum 10 is rigidly affixed to the tubular wall of the exhaust tube assembly 44.

A screen (not shown) may be placed within the exhaust tube assembly 44 to block oversized solids from entering the dust collection assembly 14. For example, a 25-mesh to 60-mesh nylon screen may be placed within cylindrical exhaust tube. In such embodiments, a pulse of cleaning gas may be periodically applied to the downstream side of the screen to provide a reverse gas flow at a sufficient velocity to clear accumulated particles from the upstream side of the screen.

Figure 2:
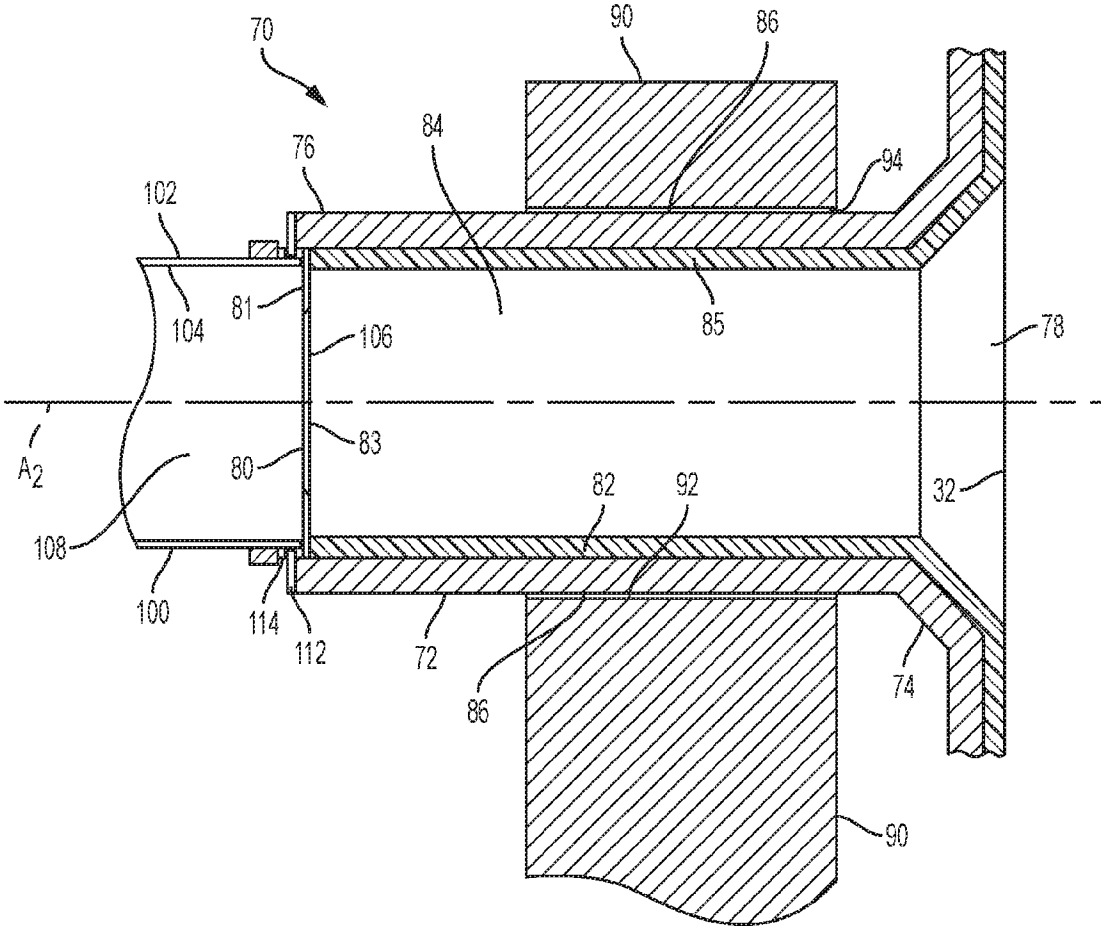
FIG. 2 is a partial schematic view of an intake assembly for a device for separating fine particulate material from a mixture of coarse particulate material and fine particulate material.

FIG. 2 shows an intake assembly 70 suitable for use with a tumbler drum, such as the tumbler drum 10 shown in FIG. 1. The intake assembly 70 has an intake tube 72 that is affixed to and extends outwardly from the drum wall 30. The intake tube has a proximal end 74 that is nearest to the drum wall 30, a distal end 76 that is located a distance away from the drum wall 30. In the illustrated arrangement, an intake tube outlet 78 is located at the proximal end 74, and an intake tube inlet 80 is located at the distal end 76. The intake tube 72 has an inner wall surface 82. The inner wall surface 82 defines an intake tube passageway 84 that extends axially through the intake tube 72 from the intake tube inlet 80 to the intake tube outlet 78. The intake tube passageway 84 is in communication with the drum chamber 22 via the intake tube outlet 78 and the sweep gas inlet 32 to allow a flow of gas from intake tube passageway 84 to the drum chamber 22. An orifice ring 81 is mounted at the distal end 76 of the intake tube 72 and defines an orifice 83 that serves as the intake tube inlet 80. The illustrated orifice ring 81 defines an axially extending orifice 83 that is generally circular in radial cross-section. The diameter of the illustrated orifice 83 is less than the diameter of the inwardly facing surface that defines the intake tube passageway 84.

Advantageously the tumbler drum 10 will have trunnions that are supported by a stand having cradles that support the trunnions for rotation about the axis of rotation $A_1$. In the assembly shown in FIG. 2, the intake tube 72 has an outer wall surface 86. At least a portion of the intake tube outer wall surface 86 is a cylinder having a circular cross-section with an axis $A_2$ at the center of the cylinder. The intake tube 72 is affixed to the drum with the axis $A_2$ coinciding with the axis of rotation $A_1$, such that the intake tube 72 rotates with the drum and can act as a trunnion. The center of the illustrated circular orifice 83 is located on the axis $A_2$. A stand member 90 a includes a cradle 92 that supports the outer wall surface 86 for rotation of the intake tube 72 about the axis of rotation $A_1$. In the particular intake tube assembly of FIG. 2, the stand member 90 has a generally horizontally extending bore 94 defined by a circular cylindrical surface, with the cradle 92 being a bottom portion of the surface that defines of the bore and supports the outer wall surface 86. The bore 94 has a centerline or axis that generally coincides with the axis of rotation $A_1$.

A sweep gas supply duct 100 has a wall 102. The wall 102 has an inner wall surface 104 that defines a gas supply duct outlet 106 and a gas supply duct passageway 108 that extends through the gas supply duct 100 to the gas supply duct outlet 106. The gas supply duct passageway 108 is in communication with the sweep gas source 12 to permit a flow of gas from the sweep gas source 12 to the gas supply duct passageway 108; and the gas supply duct outlet 106 is aligned with the intake tube inlet 80. Sweep gas therefore can travel from the sweep gas source 12 into the drum chamber 22 via the gas supply duct passageway 108 and the intake tube passageway 84. The diameter of the illustrated orifice 83 is less than the diameter of the cylindrical inner wall surface 104 that defines the gas supply duct passageway 108.

The sweep gas supply duct 100 is fixed and does not rotate with the intake tube 72. A seal mechanism therefore is provided at the junction of the rotatory intake tube 72 and the fixed sweep gas supply duct 100 to block the escape of gas therebetween. In the assembly of FIG. 2, a seal is located at the distal end 76 of the intake tube 72. In particular, a rigid seal ring 112 is secured at the distal end 76 of the intake tube 72 and has surfaces that extend perpendicular to the axis $A_2$. A flexible v-ring seal 114 is secured to gas supply duct 100, extends between the outer surface of the sweep gas supply duct 100 and the seal ring 112, and acts as a barrier to the escape of gas to the atmosphere surrounding the apparatus. Because the illustrated orifice ring 81 is located between the v-ring seal 114 and drum chamber 22, the orifice ring acts to prevent granular polysilicon from splashing into a region from which it could foul the v-ring seal. The orifice ring 81 thus protects the v-ring seal 114 by providing an annular dam to block polysilicon from flowing to the v-ring seal from the intake tube passageway 84. The relatively small cross-sectional area of the orifice 83 is a constriction in the sweep gas flow pathway, so the velocity of sweep gas moving through the through the orifice 83 is higher than the velocity of gas flowing through the intake tube passageway 84. The elevated gas flow velocity through the orifice 83 inhibits silicon material from moving upstream through the orifice and thereby protects the v-ring seal 114. The illustrated seal mechanism is advantageous in that the coefficient of friction between the sealing ring 112 and the flexible v-ring seal 114 is relatively low as compared to other rotary sealing arrangements, so a relatively low amount of torsional force is required to initiate and sustain rotation of the drum 10 and the life of the seal is relatively long.

Figure 3:
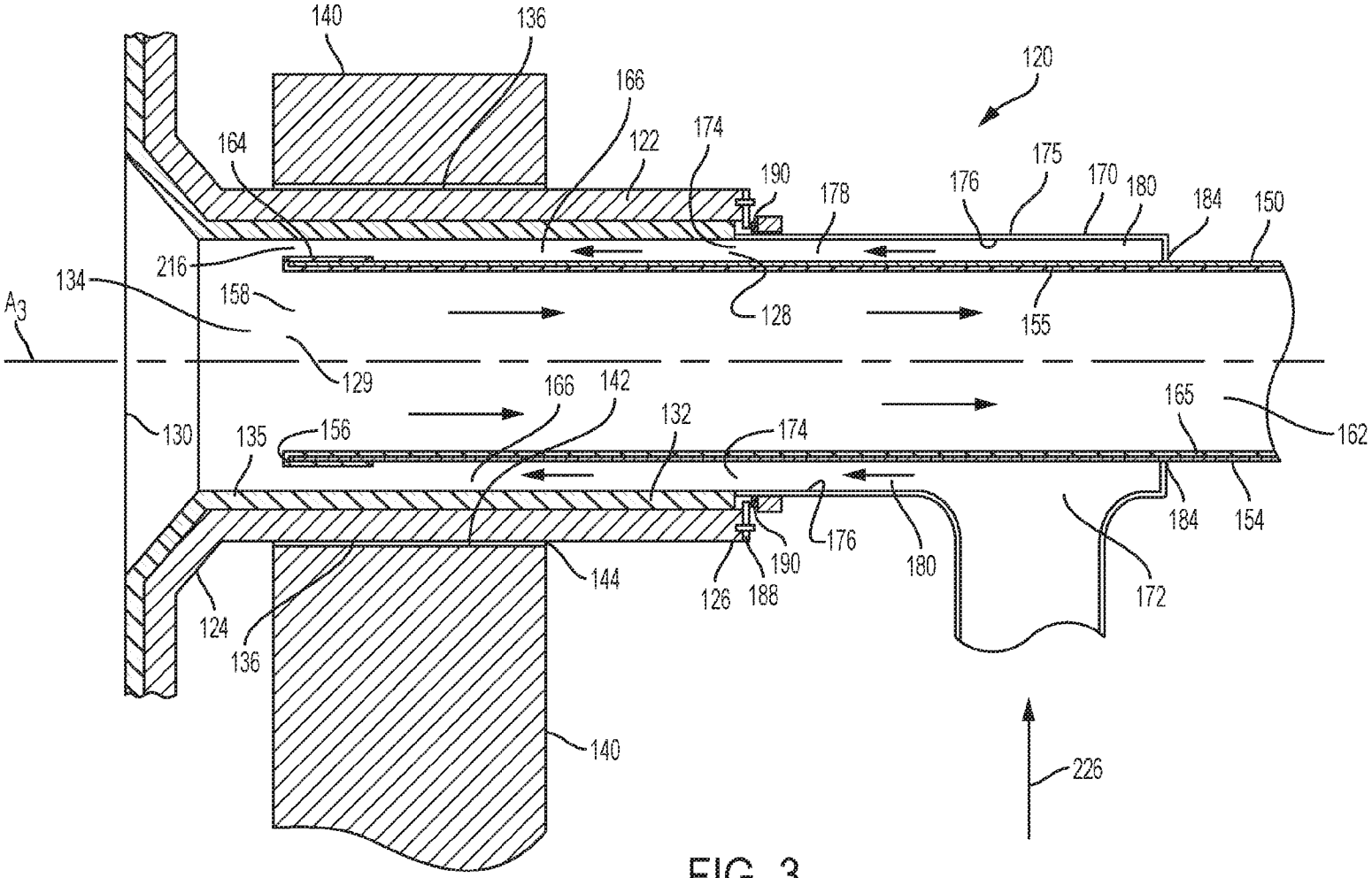
FIG. 3 is a partial schematic view of an exhaust assembly for a device for separating fine particulate material from a mixture of coarse particulate material and fine particulate material.

FIG. 3 shows a discharge assembly 120 suitable for use with a tumbler drum, such as the tumbler drum 10 of an apparatus for separating granular polysilicon and silicon powder shown in FIG. 1. The assembly of FIG. 3 differs in construction from the exhaust tube assembly 44 shown in FIG. 1. In particular, the assembly of FIG. 3 incorporates a gas-flushed seal. Advantageously such a seal can be non-contaminating and can, for example, be devoid of any packing or lubrication and therefore prevent silicon powder and granules from contacting packing or lubricants.

An exhaust tube 122 is affixed to and extends outwardly from the drum wall 40. The exhaust tube 122 has a proximal end 124 that is nearest to the drum wall 40, a distal end 126 that is located a distance away from the drum wall 40. In the illustrated arrangement, the exhaust tube 122 has a distal exhaust tube opening 128 that is located at the distal end 126 and a proximal exhaust tube opening 130 that is located at the proximal end 124. An exhaust tube outlet 129 is located at a position that is outwardly of the drum wall 40 and downstream in the flow path of sweep gas exiting the drum chamber 22. The exhaust tube 122 has an inner wall surface 132. The inner wall surface 132 defines an exhaust tube passageway 134 that extends axially through the exhaust tube 122 from the proximal exhaust tube opening 130 to the distal exhaust tube opening 128. The exhaust tube passageway 134 is in communication with the drum chamber 22 via the proximal exhaust tube opening 130 and the sweep gas outlet 42 to permit a flow of gas from the drum chamber 22 to the exhaust tube passageway 134.

The exhaust tube 122 has an outer wall surface 136. In the illustrated assembly, at least a portion of the exhaust tube outer wall surface 136 is a cylinder having a circular cross-section with an axis $A_3$ at the center of the cylinder. The exhaust tube 122 is affixed to the drum with the axis $A_3$ aligned with the axis $A_2$ of the circular cylindrical outer wall surface of the intake tube 72. Both the axes $A_2$ and $A_3$ coincide with the axis of rotation $A_1$. The exhaust tube 122 therefore rotates with the drum and can act as a trunnion. A stand member 140 includes a cradle 142 that supports the outer wall surface 136 for rotation of the exhaust tube 122 about the axis of rotation $A_1$. In the particular exhaust tube assembly of FIG. 3, the stand member 140 has a generally horizontally extending bore 144 defined by a circular cylindrical surface, with the cradle 142 being a bottom portion of the surface that defines of the bore and supports the outer wall surface 136.

The assembly of FIG. 3 also includes an exhaust duct 150, sometime referred to herein as the ventilation duct or vent duct. The exhaust duct 150 is positioned between the sweep gas outlet 42 and the dust collection assembly 14 with the exhaust duct being in fluid communication with sweep gas outlet and the dust collection assembly to permit a flow of gas and entrained silicon powder from the sweep gas outlet to the dust collection assembly. A least a portion of the exhaust duct 150 extends into the exhaust tube passageway 134. The exhaust duct 150 has a wall that has an outer wall surface 154 and an inner wall surface 155. The exhaust duct 150 also has an inlet end 156 that defines an exhaust duct inlet 158, an exhaust duct outlet (not shown), and an exhaust duct passageway 162 that extends axially through the exhaust duct 150 from the exhaust duct inlet 158 to the exhaust duct outlet. The exhaust duct outlet advantageously may be located at the inlet of the dust collection assembly 14. The exhaust duct inlet 158 is positioned such that the exhaust duct passageway 162 is in communication with drum chamber 22 to permit a flow of gas and entrained silicon powder from the drum chamber to the exhaust duct passageway. In particular, in the illustrated exhaust assembly, the exhaust duct inlet 158 is located outside of the drum chamber 22 such that the drum chamber is in communication with the exhaust duct passageway 162 via a portion of the exhaust tube passageway 134. In the assembly of FIG. 3, the exhaust duct inlet 158 therefore serves as the exhaust tube outlet 129. In some embodiments the exhaust duct 150 is positioned such that the exhaust duct inlet end 156 is located at the proximal exhaust tube opening 130, or the exhaust duct 150 extends into the drum chamber 22 such that the exhaust duct inlet end 156 is located inside the drum chamber; but such embodiments could be disadvantageous because the exhaust duct might interfere with the tumbling of materials inside the drum chamber.

The exhaust duct 150 is located within the exhaust tube passageway 134 in a position such that a gap 166, sometimes referred to herein as a "first gap" or "proximal gap," is defined between a portion of the outer wall surface 154 of the exhaust duct 150 and a portion of the inner wall surface 132 of the exhaust tube 122. In the illustrated assembly, a portion of the inner wall surface 132 of the exhaust tube 122 is a cylinder having a circular cross-section and a portion of the outer wall surface 154 of the exhaust duct 150 is a cylinder having a circular cross-section. The portion of the inner wall surface 132 of the exhaust tube 122 is of a greater diameter than the portion of the outer wall surface 154 of the exhaust duct 150. And the portion of the inner wall surface 132 of the exhaust tube 122 and the portion of the outer wall surface 154 of the exhaust duct 150 are coaxial such that at least a portion of the gap 166 between the exhaust tube 122 and the exhaust duct 150 is an annular gap that entirely surrounds the outer wall surface 154. A source of clean flush gas is in communication with the gap 166 to inject gas to the gap.

The assembly of FIG. 3 also includes a flush gas supply duct 170 that mates with and extends outwardly from the distal end 126 of the exhaust tube 122. The flush gas supply duct 170 has a flush gas supply duct inlet 172, a flush gas supply duct outlet 174, an outer wall surface 175, and an inner wall surface 176 that defines a flush gas supply duct passageway 178. The flush gas supply duct passageway 178 extends through the flush gas supply duct 170 from the flush gas supply duct inlet 172 to the flush gas supply duct outlet 174 and is in communication with the gap 166 via the flush gas supply duct outlet 174 to permit a flow of gas from the flush gas supply duct passageway to the gap.

A portion of the exhaust duct 150 is located within the flush gas supply duct passageway 178 in a position such that a gap 180, sometimes referred to herein as a "second gap" or "distal gap," is defined between a portion of the outer wall surface 154 of the exhaust duct 150 and a portion of the inner wall surface 176 of the flush gas supply duct 170. In the illustrated assembly, a portion of the inner wall surface 176 of the flush gas supply duct 170 is a cylinder having a circular cross-section and a portion of the outer wall surface 154 of the exhaust duct 150 is a cylinder having a circular cross-section. The portion of the inner wall surface 176 of the flush gas supply duct 170 is of a greater diameter than the portion of the outer wall surface 154 of the exhaust duct 150. And the portion of the inner wall surface 176 of the flush gas supply duct 170 and the portion of the outer wall surface 154 of the exhaust duct 150 are coaxial such that at least a portion of the gap 180 between flush gas supply duct 170 and the exhaust duct 150 is an annular gap that entirely surrounds the outer wall surface 154. A source of flush gas is in communication with the gap 180 via the flush gas supply duct inlet 172 to inject gas to the gap 180. An annular portion of the gap 166 and an annular portion of the gap 180 are aligned at the junction of the exhaust tube 122 and the flush gas supply duct 170 so that the gap 166 is in communication with the gap 180 to permit a flow of gas from the gap 180 to the gap 166. In effect, in the assembly shown in FIG. 3, a continuous annular gap, including portions of the gap 166 and the gap 180, extends along the outer surface 154 of the exhaust duct 150 from the flush gas supply duct inlet 172 to the inlet end 156 of the exhaust duct 150. The inner wall surface 176 of the flush gas supply duct 170 is fixedly sealed to the outer surface 154 of the exhaust duct 150 at an annular location 184 shown in FIG. 3 as a barrier to the escape of gas from the gaps 166, 180 to atmosphere surrounding the apparatus.

The illustrated flush gas supply duct 170 is fixed and does not rotate with the exhaust tube 122. A seal mechanism therefore is provided at the junction of the exhaust tube 122 and the gas supply duct 170. The seal extends between the flush gas supply duct 170 and the exhaust tube 122 to block the escape of gas therebetween. In particular, in the assembly of FIG. 3, a rigid seal ring 188 is secured at the distal end 126 of the exhaust tube 122 and has surfaces that extend perpendicular to the axis $A_3$. A flexible v-ring seal 190 is secured to the outer surface 175 of the flush gas supply duct 170, extends between the outer surface 175 and the seal ring 188, and acts as a barrier to the escape of gas to the atmosphere surrounding the apparatus. The illustrated seal mechanism further is advantageous in that the coefficient of friction between the sealing ring 188 and the flexible v-ring seal 190 is relatively low as compared to other rotary sealing arrangements, so a relatively low amount of torsional force is required to initiate and sustain rotation of the drum 10 and the life of the seal is relatively long.

Surfaces that come into contact with the granular polysilicon and/or silicon powder, advantageously will be made of or covered with a material that is non-contaminating, such as quartz, silicon carbide, silicon nitride, silicon, polyurethane, polytetrafluoroethylene (PTFE, Teflon® (DuPont Co.)), or ethylene tetrafluoroethylene (ETFE, Tefzel® (DuPont Co.)). Polyurethane treatments, as described below, are particularly beneficial. Surfaces that may benefit from a treatment include interior surfaces of the tumbler drum side wall 20, the first end wall 30, and the second end wall 40. Advantageously, at least a portion of the inner wall surface 82 of the intake tube 72 comprises or is coated with polyurethane, as shown in FIG. 2. In particular a polyurethane lining 85 is provided as a coating on the inner wall surface 82. Advantageously, at least a portion of the inner wall surface 132 of the exhaust tube 122 comprises or is coated with polyurethane as shown in FIG. 3. In particular, a polyurethane lining 135 is provided as a coating on the inner wall surface 132. Advantageously, at least a portion of the outer wall surface 154 of the exhaust duct 150 and at least a portion of the inner wall surface 155 will comprise or be coated with polyurethane. In particular, a polyurethane lining 164 is provided as a coating on a small region of the outer wall surface 154 near the proximal end of the exhaust duct 150, which defines the exhaust duct inlet 158. A polyurethane lining 165 is provided as a coating on the inner wall surface 155 along the entire lengthy of the exhaust duct passageway 162. And a polyurethane lining is provided as a coating on the inlet end 156 of the exhaust duct 150.

As used herein, the term "polyurethane" may also include materials where the polymer backbone comprises polyureaurethanes or polyurethane-isocyanurate linkage. The polyurethane may be a microcellular elastomeric polyurethane.

The term "elastomeric" refers to a polymer with elastic properties, e.g., similar to vulcanized natural rubber. Thus, elastomeric polymers can be stretched, but retract to approximately their original length and geometry when released. The term "microcellular" generally refers to a foam structure having pore sizes ranging from 1-100 μm.

Microcellular materials typically appear solid on casual appearance with no discernible reticulate structure unless viewed under a high-powered microscope. With respect to elastomeric polyurethanes, the term "microcellular" typically is defined by density, such as an elastomeric polyurethane having a bulk density greater than 600 kg/m$^3$. Polyurethane of lower bulk density typically starts to acquire a reticulate form and is generally less suited for use as the protective coating described herein.

Microcellular elastomeric polyurethane suitable for use in the disclosed application is that having a bulk density of 1150 kg/m$^3$ or less, and a Shore Hardness of at least 65 A. In one embodiment the elastomeric polyurethane has a Shore Hardness of up to 90 A, such as up to 85 A; and from at least 70 A. Thus, the Shore Hardness may range from 65 A to 90 A, such as 70 A to 85 A. Additionally, the suitable elastomeric polyurethane will have a bulk density of from at least 600 kg/m$^3$, such as from at least 700 kg/m$^3$ and more preferably from at least 800 kg/m$^3$; and up to 1150 kg/m$^3$, such as up to 1100 kg/m$^3$ or up to 1050 kg/m$^3$. Hence, the bulk density may range from 600-1150 kg/m$^3$, such as 800-1150 kg/m$^3$, or 800-1100 kg/m$^3$. The bulk density of solid polyurethane is understood to be in the range of 1200-1250 kg/m$^3$. In one embodiment, the elastomeric polyurethane has a Shore Hardness of from 65 A to 90 A and a bulk density of from 800 to 1100 kg/m$^3$.

Elastomeric polyurethane can be either a thermoset or a thermoplastic polymer; this presently disclosed application is better suited to the use of thermoset polyurethane, particularly thermoset polyurethane based on polyester polyols. Microcellular elastomeric polyurethane having the above physical attributes is observed to be particularly robust, and withstands the abrasive environment and exposure to particulate granulate silicon eminently better than many other materials.

In some embodiments, a polyurethane coating is applied to a surface, such as to the surface of a metal wall. The polyurethane coating may be secured by any suitable means. In one embodiment, a polyurethane coating is cast in situ and adheres to a surface as it is cast. In another embodiment, a polyurethane coating is secured to a surface using a bonding material, e.g., an epoxy such as West System 105 Epoxy Resin® with 206 Slow Hardener® (West System Inc., Bay City, Mich.). In another embodiment, a polyurethane coating is secured to a surface using double-sided adhesive tape, e.g., 3M™ VHB™ Tape 5952 (3M, St. Paul, Minn.). In still another embodiment, a polyurethane coating is secured by one or more support members and bolts.

The polyurethane coating typically will be present in an overall thickness of from at least 0.1, such as from at least 0.5, from at least 1.0, or from at least 3.0 millimeters; and up to a thickness of about 10, such as up to about 7, or up to about 6 millimeters. Thus, the polyurethane coating may have a thickness from 0.1-10 mm, such as 0.5-7 mm or 3-6 mm.

Figure 4:
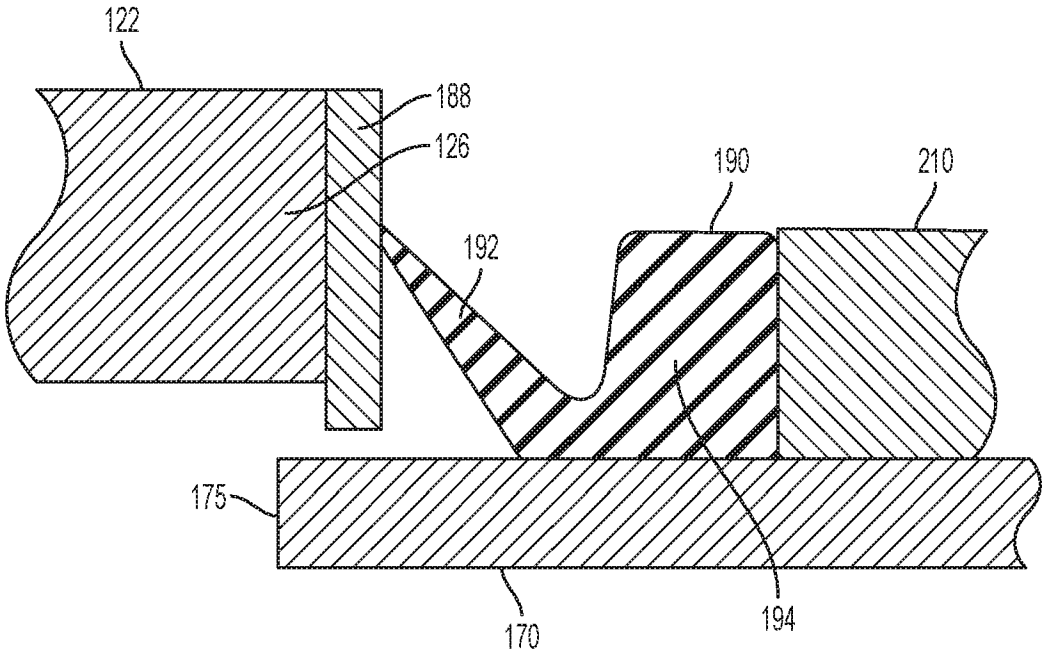
FIG. 4 is a partial schematic view of a seal for a device for separating fine particulate material from a mixture of coarse particulate material and fine particulate material.

FIG. 4 shows an exemplary v-ring seal arrangement, which may be used to provide the seal 114 and the seal 190. In reference to the seal mechanism 190, FIG. 4 shows the exhaust tube 122 and the flush gas supply duct 170. The rigid seal ring 188 is secured at the distal end 126 of the exhaust tube 122. The flexible v-ring seal 190 is secured to the outer surface 175 of the flush gas supply duct 170, extends between the outer surface 175 and the seal ring 188, and acts as a barrier to the escape of gas therebetween to the atmosphere surrounding the apparatus. The illustrated v-ring seal 190 has a body portion 194 and a conically shaped sealing lip or v-ring portion 192. The lip portion 192 can move toward the body portion 194, in the manner of a leaf of a hinge, upon the application of sufficient force. The v-ring seal 190 is a single, continuous band that, in its unstressed state prior to installation, has a smaller diameter than the duct 170 and must be stretched while installing it similar to a rubber band. The installed v-ring seal 190 chokingly engages the surface 175 and thereby provides a radial seal between the v-ring seal 190 and the duct 170. In the illustrated arrangement, the v-ring seal 190 does not rotate because the seal is secured to the flush gas supply duct 170, which is stationary; in other arrangements (not shown), a v-ring seal could be mounted on and rotate with the exhaust tube 122. In the arrangement of FIG. 4, the v-ring portion 192 is installed with the higher pressure ventilation side on the inside surface of the "V" which provides an increased amount of leakage with higher differential pressure. This limits the amount of force applied between the tip of the v-ring portion 192 and the sliding surface of the seal ring 188, which limits friction forces and heat buildup, which enables the seal to have a longer service life. This configuration helps limit the amount of seal wear products from both the v-ring portion 192 and seal ring body portion 194 from causing product contamination since this material would be swept away from the seal with any seal leakage. Suitable v-ring seals include seals made by the SKF Company (Aktiebolaget SKF, Goteborg, Sweden) of fluoro rubber compound (SKF Duralife™). A backing ring 210 is secured to the outer surface 175 of the flush gas supply duct 170. The backing ring 210 prevents the v-ring seal 190 from sliding along the outer surface 175 and moving away from the seal ring 188.

Figure 5:
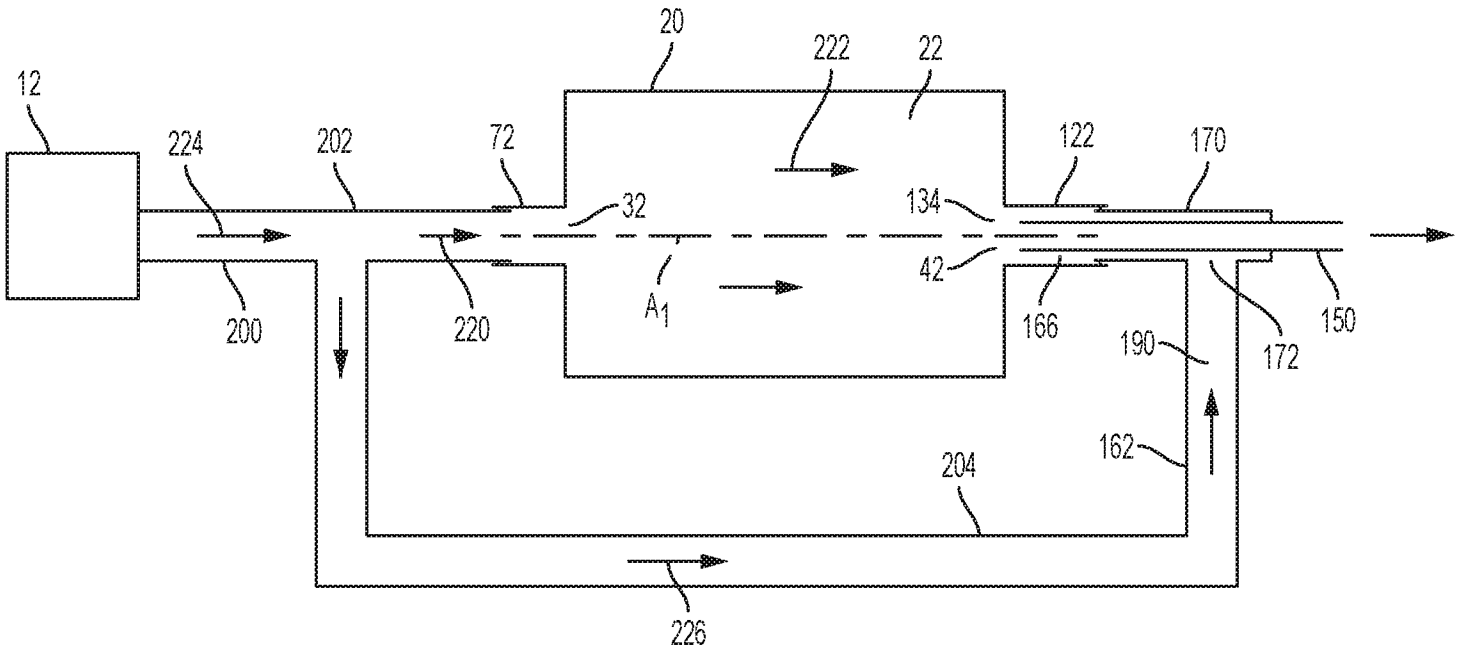
FIG. 5 is a partial schematic view of a gas flow path for a device for separating fine particulate material from a mixture of coarse particulate material and fine particulate material.

FIG. 5 illustrates an advantageous arrangement in which the source of sweep gas and the source of flush gas are a common gas source 12. The common gas source 12 is in communication with the sweep gas inlet 32 so that a first portion of gas from the common gas source can flow into the drum chamber 22 via the sweep gas inlet 32 and serve as sweep gas. The common gas source 12 also is in communication with the gap 166 so that a second portion of gas from the common gas source 12 can flow into the gap and serve as flush gas. In the illustrated apparatus, a gas feed tube 200 extends from the common gas source 12 and is in communication with a T-junction 202. The T-junction 202 is in communication with the passageway 84 of the intake tube 72. The T-junction 202 also is in communication with the passageway of a bypass tube 204. The passageway of the bypass tube 204 in turn is in communication with the flush gas supply duct inlet 172, and thereby is in communication with the gap 166. Appropriate sensors, controllers and valves (not shown) are provided to control the flows of gas through the various passageways. A flow control orifice may be provided in the sweep gas intake passageway downstream of the T-junction 202, advantageously between the T-junction 202 and the intake tube 72, to narrow the sweep gas intake passageway and thereby provide enough pressure drop to direct a substantial portion of the gas flow to flush the gap 166 and to supply the balance of the gas flow to the sweep gas inlet 32 and provide an axial flow of sweep gas through the tumbler drum chamber 22 to extract the polysilicon dust and remove it via the sweep gas outlet 42.

In operation, a polysilicon material that is a mixture of granular polysilicon and silicon powder is introduced into the chamber of the tumbler drum. The tumbler drum 10 is rotated. As the tumbler drum 10 rotates, the one or more lifting vanes 60 carry a portion of the polysilicon material upward. As each lifting vane 60 rotates upward past a horizontal orientation, the polysilicon material carried by that lifting vane 60 falls downward. The tumbler drum 10 is rotated at any suitable speed, such as a speed from 1-100 rpm, 2-75 rpm, 5-50 rpm, 10-40 rpm or 20-30 rpm. The speed is selected to effectively separate at least some of the powder from the polysilicon granules as portions of the mixture are lifted—e.g., by one or more lifting vanes—and fall as the tumbler drum rotates. A person of ordinary skill in the art understands that the selected speed may depend at least in part on the size of the tumbler drum and/or the mass of the mixture within the tumbler drum.

A flow 220 of sweep gas is introduced into the drum chamber 22 via a sweep gas inlet, such as the sweep gas inlet 32 at one end of the drum chamber. The introduced sweep gas 222 passes through the drum chamber 22 and is discharged through a gas outlet, such as the sweep gas outlet 42 at the other end of the drum. The sweep gas may be air or an inert gas (e.g., argon, nitrogen, helium). In some advantageous examples, the sweep gas is nitrogen.

As the tumbler drum rotates, loose silicon powder becomes airborne and forms a cloud within the drum chamber. The sweep gas flow rate through the chamber 22 is maintained to be sufficiently high to entrain the loose silicon powder and carry it out of the drum chamber via the outlet 42; however, the sweep gas flow rate is not sufficient to entrain polysilicon granules. At sufficiently low sweep gas flow rates and/or tumbling speeds, granular polysilicon is not entrained by the flowing gas and remains in the drum chamber 22. However, lower gas flow rates and/or rotational speeds may be less effective at removing dust and polishing the polysilicon granules. Thus, sweep gas flow rate and/or rotational speed may be increased to improve efficacy. Advantageously, when the sweep gas is air, a sufficient gas flow rate is maintained to keep the airborne dust concentration within the drum chamber less than the minimum explosible concentration (MEC). A lower sweep rate can be used when the sweep gas is inert (e.g., nitrogen, argon, helium). Suitable sweep gas axial flow velocities may range from 15 cm/sec to 40 cm/sec (0.5 ft/sec to 1.3 ft/sec) in the drum chamber and from 200 cm/sec to 732 cm/sec (6.6 ft/sec to 24.0 ft/sec) in an exhaust duct connected to the outlet.

The atmosphere in the tumbler drum may be humidified (for example, by flowing humidified sweep gas through the tumbler drum). Without being bound by theory, it is believed that maintaining a relative humidity in the drum chamber results in formation of a water film on surfaces of the polysilicon granules and silicon powder in the drum chamber. Formation of a water film of sufficient thickness is believed to weaken the van der Waals forces (London forces) to permit separation of dust particles from the granular polysilicon, and facilitate entrainment of dust particles and their removal from the drum chamber in the sweep gas.

Thus, in some embodiments, the sweep gas flowing through the tumbler drum chamber from the gas inlet to the gas outlet is humidified prior to its introduction into the drum chamber through the gas inlet. In some examples, the sweep gas is humidified by injecting water (such as purified, for example, deionized water) in the sweep gas flow, for example by manually adding water to a filter between the sweep gas source and the gas inlet or a fitting of the filter. As the sweep gas flows through the filter, water vapor is picked up by the sweep gas. In other examples, the sweep gas is humidified by a humidifier placed between the sweep gas source and the gas inlet. In a specific, non-limiting example, the sweep gas is humidified using a RainMaker® humidification system (RASIRC, San Diego, Calif.).

Except for the tumbler drum assembly, components of the apparatus for separating granular polysilicon and silicon powder are stationary. Seals are located at the interfaces of the tumbler drum assembly with fixed gas intake apparatus and fixed gas discharge apparatus. The seals allow sweep gas to move through the gas inlet and the gas outlet as the drum rotates, while blocking the escape of sweep gas to the atmosphere surrounding the rotating tumbler drum. In the particular arrangement described above with reference to the apparatus shown in FIGS. 2-3, the tumbler drum 10 advantageously has an intake tube 72 and an exhaust tube 122 that rotate with the tumbler drum about the axis of rotation $A_1$. Sweep gas is delivered to the drum chamber 22 via the passageways 84 that extends axially through the intake tube 72 and is conveyed away from the drum chamber 22 via the passageway 134 that extend axially through the exhaust tube 122.

The seal 190, which is located at the distal end 126 of the exhaust tube 122, is protected by a flow of clean flush gas that is delivered to the vicinity of the seal to inhibit silicon material from approaching the seal. In particular, whenever sweep gas and entrained silicon powder are flowing through the sweep gas outlet 42 into the exhaust tube passageway 134, a flow of flush gas is supplied to the gap 166 between the outer wall surface 154 and the inner wall surface 132. The flush gas is provided in the gap 166 at a pressure that is higher than the gas pressure in the exhaust duct passageway 162. The flow of flush gas therefore moves through the gap 166 toward the drum chamber 22 to provide a barrier to the entry of solids into the gap thorough an annular opening 216 that is defined between the exhaust tube 122 and the exhaust duct 150 at the inlet end 156 of the exhaust duct. After flush gas is discharged from the gap 166 through the annular opening 216, the flush gas mergers with the sweep gas and is carried out with the sweep gas through the exhaust duct passageway 162. The flow rate of flush gas through the annular opening 216 is regulated so as to be sufficient to inhibit silicon powder from entering the gap 166 and thereby sufficient to protect the seal 190 from the abrasive effect of silicon powder. Advantageously, gas will be caused to flow axially through the annular opening at a rate of from 820 cm/sec to 1040 cm/sec (from 27 ft/sec to 34 ft/sec). With such an arrangement, the exhaust seal is non-contaminating because silicon powder is prevented from contacting any metal surfaces, packing or lubricant that may be located between the exhaust tube 122 and the exhaust duct 150. And as previously mentioned, the gap 166 and the interface between the exhaust tube 122 and the exhaust duct 150 advantageously will be devoid of any packing or lubrication.

With the system shown in FIG. 5, a flow 224 of gas from the common gas source 12 can be directed to flow into the drum chamber 22 via the sweep gas inlet 32. Simultaneously, a flow 226 of gas from the common gas source 12 can be directed to flow into the gap 166 between the rotating exhaust tube 122 and the exhaust duct 150. The axial velocity of gas passing through the gap 166 is maintained at a sufficiently high rate to force any polysilicon entering the gap back into a position from which it reenters the tumbler drum chamber 22 or enters the exhaust duct passageway 162. More particularly, in the system shown in FIG. 5, gas from the common gas source 12 is supplied to the passageway of a feed tube 200. The flow 224 of gas through the feed tube 200 is split at the T-junction 202. A first portion 220 of the gas flows to the gas inlet 32 via the passageway of the intake tube 72. A second portion 226 of the gas flows to the gap 166 via the bypass tube 204 and the flush gas supply duct inlet 172. The velocity of the flow 226 is regulated such that flush gas moves counter-currently through the gap 166 and flows from the gap into the exhaust tube passageway 134. The flow 226 of flush gas blocks silicon powder from entering the gap 166 and coming into contact with the seal 190, thereby greatly reducing abrasion of the apparatus at the location of the seal and avoiding rapid equipment failure. When using the illustrated system, the volume of the first portion 220 of the gas is a greater than the volume of the second portion 226 of the gas. The volumes and velocities of the first and second portions 220, 226 of the gas stream are adjusted as may be needed to accomplish both dust separation in the tumbler drum 22 and flushing of the gap 166.

The entrained silicon powder may be collected by any suitable means, such as by flowing the exiting gas and entrained powder through a filter. For example, using the apparatus shown in FIG. 3, gas and entrained powder may be passed through the exhaust duct passageway 162 to the dust collection assembly 14.

During the dedusting process, gas flow rates, gas pressure, humidity, and tumbler rotation can be monitored and regulated by appropriate sensors, controllers, pumps and valves (not shown).

After a period of time, rotation and sweep gas flow are ceased and the drum chamber 22 is emptied via port 50. The polysilicon material removed from the drum chamber 22 includes a reduced percentage by weight of silicon powder than the material introduced into the drum chamber. The initial polysilicon material may comprise from 0.25% to 3% powder by weight. In some embodiments, the tumbled polysilicon material comprises less than 0.1% powder by weight, such as less than 0.05% powder, less than 0.02% powder, less than 0.015% powder, less than 0.01% powder, less than 0.005% powder or even less than 0.001% powder by weight. In one example operation, wherein water vapor was provided in the chamber 22 of the tumbler drum, the removed tumbled polysilicon material had less than 0.002% powder by weight. In some embodiments, the granular polysilicon and/or the separated powder is dried after removal from the tumbler drum.

Dedusting by the procedure described above can produce a granular polysilicon product having less than 5 ppba of added contaminants. In particular, the combined amount of carbon, boron and phosphorous acquired during processing in the apparatus can be less than 5 ppba.

In one embodiment, the tumbling process is a batch process wherein a quantity of polysilicon material is introduced into the drum chamber via a port. After processing as described above, the tumbled polysilicon material is removed from the drum chamber (e.g., through the port), and another quantity of polysilicon material is introduced into the drum chamber.

Although the foregoing discussion most specifically refers to the dedusting of silicon granules, it should be appreciated that the apparatus and methods described herein can be used for the dedusting of other granular materials. The apparatus and methods described herein are particularly useful for working with hard materials that, like silicon, are abrasive to processing and handling equipment that is made of a softer material such as steel.

In view of the many possible embodiments to which the principles of the disclosure may be applied, it should be recognized that the illustrated embodiments are only examples and should not be taken as limiting the scope of the invention. Rather, the scope of the invention is defined by the following claims.

The invention claimed is:

1. Apparatus for separating fine particulate material from a mixture of coarse particulate material and fine particulate material, the apparatus comprising:

a tumbler drum that is supported for rotation about an axis of rotation, that has a drum wall that defines a drum chamber, that is suitable for separating a fine particulate material from a coarse particulate material contained in the drum chamber by passing a sweep gas through the drum chamber, and that has a coaxial outlet for discharging the sweep gas;

a seal located at the coaxial outlet, wherein the seal comprises an exhaust tube and an exhaust duct that are in a spaced apart relationship such that a gap is defined between the exhaust duct and the exhaust tube; and a source of a flush gas in communication with the gap.

2. The apparatus of claim 1 wherein:

the tumbler drum has a first end wall, a second end wall, a side wall that extends between the end walls and together with the end walls define the drum chamber, the side wall configured to produce a primary transverse particle flow and a secondary transverse particle flow in the drum chamber by rotation of the tumbler drum;

the side wall, the first end wall, the second end wall, or a combination thereof define a gas inlet and an outlet, with the gas inlet and the outlet being at spaced apart locations;

the tumbler drum has a port that extends through the side wall, the port being configured to provide access to the drum chamber for introducing the polysilicon material into the drum chamber and for removing the tumbled polysilicon material from the drum chamber;

the axis of rotation extends through the drum chamber; and the apparatus further comprises a source of sweep gas fluidly connected to the gas inlet, a dust collection assembly fluidly connected to the outlet, and a source of motive power operable to rotate the tumbler drum about the axis of rotation.

3. The apparatus of claim 2 wherein:

the exhaust tube is affixed to and extends from second end wall;

the exhaust tube has a proximal end, a distal end, an outer wall surface and an inner wall surface that defines a proximal exhaust tube opening, a distal exhaust tube opening, and an exhaust tube passageway that extends axially through the exhaust tube from the proximal exhaust tube opening to the distal exhaust tube opening;

the exhaust tube passageway is in communication with the drum chamber via the proximal exhaust tube opening;

a least a portion of the exhaust duct extends into the exhaust tube passageway; the exhaust duct comprises a wall that has an outer wall surface and an inner wall surface that defines an exhaust duct inlet, an exhaust duct outlet, and an exhaust duct passageway that extends axially through the exhaust duct from the exhaust duct inlet to the exhaust duct outlet;

the exhaust duct inlet is positioned such that the exhaust duct passageway is in communication with drum chamber;

the exhaust duct is located such that a gap is defined between a portion of the outer wall surface of the exhaust duct and a portion of the inner wall surface of the exhaust tube; and the apparatus further comprises a source of flush gas in communication with the gap between the exhaust duct and the exhaust tube.

4. A method for separating silicon powder from a mixture of granular polysilicon and silicon powder, comprising:

introducing a polysilicon material that is a mixture of granular polysilicon and silicon powder into the drum chamber of an apparatus according to claim 1;

rotating the tumbler drum about the axis of rotation at a rotational speed for a period of time;

flowing sweep gas from the sweep gas source through the drum chamber from the sweep gas inlet to the sweep gas outlet while the tumbler drum is rotating, thereby entraining separated silicon powder in the sweep gas;

passing sweep gas and entrained silicon powder through the sweep gas outlet, whereby at least a portion of the silicon powder is separated from the granular polysilicon and removed from the drum chamber; and removing tumbled polysilicon material from the drum chamber, the tumbled polysilicon material having a lower percentage by weight of silicon powder than the introduced polysilicon material.

5. Apparatus for separating silicon powder from a mixture of granular polysilicon and silicon powder, the apparatus comprising:

a tumbler drum comprising a drum wall that defines a drum chamber, a polysilicon inlet suitable for loading granular polysilicon into the drum chamber, a sweep gas inlet positioned to admit sweep gas into the drum chamber, and a sweep gas outlet positioned to discharge sweep gas from the drum chamber;

a stand that supports the tumbler drum for rotation about an axis of rotation;

an exhaust tube that is affixed to and extends from the drum wall, the exhaust tube having a proximal end, a distal end, an outer wall surface and an inner wall surface that defines a proximal exhaust tube opening, a distal exhaust tube opening, and an exhaust tube passageway that extends axially through the exhaust tube from the proximal exhaust tube opening to the distal exhaust tube opening, the exhaust tube passageway being in communication with the drum chamber via the proximal exhaust tube opening;

an exhaust duct, a least a portion of which extends into the exhaust tube passageway, the exhaust duct comprising a wall that has an outer wall surface and an inner wall surface that defines an exhaust duct inlet, an exhaust duct outlet, and an exhaust duct passageway that extends axially through the exhaust duct from the exhaust duct inlet to the exhaust duct outlet, the exhaust duct inlet being positioned such that the exhaust duct passageway is in communication with drum chamber, the exhaust duct being located such that a gap is defined between a portion of the outer wall surface of the exhaust duct and a portion of the inner wall surface of the exhaust tube;

a source of sweep gas in communication with the sweep gas inlet;

a source of flush gas in communication with the gap between the exhaust duct and the exhaust tube; and a source of motive power operable to rotate the tumbler drum about the axis of rotation.

6. The apparatus of claim 5 wherein the exhaust duct inlet is located outside of the drum chamber such that the drum chamber is in communication with the exhaust duct passageway via the exhaust tube passageway.

7. The apparatus of claim 5 further comprising:

a flush gas supply duct that extends outwardly from the distal exhaust tube opening, the flush gas supply duct having a flush gas supply duct inlet, a flush gas supply duct outlet, and an inner wall surface that defines a flush gas supply duct passageway that extends through the flush gas supply duct from the flush gas supply duct inlet to the flush gas supply duct outlet, the flush gas supply duct passageway being in communication with the gap between the exhaust tube and the exhaust duct via the flush gas supply duct outlet.

8. The apparatus of claim 7 further comprising a seal that extends between the flush gas supply duct and the exhaust gas tube, the seal being positioned as a barrier to the escape of gas from the from the exhaust tube passageway to atmosphere surrounding the apparatus.

9. The apparatus of claim 7 wherein:

a portion of the exhaust duct is located within the flush gas supply duct passageway;

a portion of the outer wall surface of the exhaust duct and a portion of the inner wall surface of the flush gas supply duct define a gap therebetween;

the gap that is located between the between the outer wall surface of the exhaust duct and the inner wall surface of the exhaust tube is aligned and in communication with the gap that is located between the outer wall surface of the exhaust duct and the inner wall surface of the flush gas supply duct;

the inner wall surface of the flush gas supply duct is sealed to the outer surface of the exhaust duct as a barrier to the escape of gas from the gaps to atmosphere surrounding the apparatus; and the apparatus further comprises a seal that extends between the flush gas supply duct and the exhaust gas tube, the seal being positioned as a barrier to the escape of gas from the gaps to atmosphere surrounding the apparatus.

10. The apparatus of claim 9 wherein:

a portion of the inner wall surface of the flush gas supply duct is a cylinder having a circular cross-section and a portion of the outer wall surface of the exhaust duct is a cylinder having a circular cross-section;

the portion of the inner wall surface of the flush gas supply duct is of a greater diameter than the portion of the outer wall surface of the exhaust duct; and the portion of the inner wall surface of the flush gas supply duct and the portion of the outer wall surface of the exhaust duct are coaxial such that at least a portion of the gap between the flush gas supply duct and the exhaust duct is an annular gap.

11. The apparatus of claim 5 wherein:

a portion of the inner wall surface of the exhaust tube is a cylinder having a circular cross-section and a portion of the outer wall surface of the exhaust duct is a cylinder having a circular cross-section;

the portion of the inner wall surface of the exhaust tube is of a greater diameter than the portion of the outer wall surface of the exhaust duct; and the portion of the inner wall surface of the exhaust tube and the portion of the outer wall surface of the exhaust duct are coaxial such that at least a portion of the gap between the exhaust tube and the exhaust duct is an annular gap.

12. The apparatus of claim 5 wherein the exhaust duct inlet is located outside of the drum chamber.

13. The apparatus of claim 5 wherein the axis of rotation extends through both the sweep gas inlet and the sweep gas outlet.

14. The apparatus of claim 5 further comprising an intake tube that is affixed to and extends outwardly from the drum wall, the intake tube having a proximal end, a distal end, an intake tube outlet located at the proximal end, an intake tube inlet located at the distal end, and an inner wall surface that defines an intake tube passageway that extends axially through the intake tube from the intake tube inlet to the intake tube outlet, the intake tube passageway being in communication with the drum chamber via the intake tube outlet and the sweep gas inlet.

15. The apparatus of claim 14 wherein:

at least a portion of the intake tube outer wall surface is shaped such that the intake tube can act as a trunnion;

the exhaust tube extends outwardly from the drum wall;

at least a portion of the exhaust tube outer wall surface is shaped such that the exhaust tube can act as a trunnion; and the stand includes cradles that support portions of the intake tube and the exhaust tube for rotation of the intake tube and the exhaust tube about the axis of rotation.

16. The apparatus of claim 15 wherein:

the at least a portion of the intake tube outer wall surface is a cylinder having a circular cross-section with an axis of rotation at the center of the cylinder;

the at least a portion of the exhaust tube outer wall is cylinder having a circular cross-section with an axis of rotation at the center of the cylinder;

the axes of rotation of the circular cylindrical outer wall surfaces are aligned;

the cradles support the circular cylindrical outer wall surfaces for rotation of the intake tube and the exhaust tube about the axes of rotation.

17. The apparatus of claim 5 wherein:

the source of sweep gas and the source of flush gas are a common gas source;

the common gas source is in communication with the sweep gas inlet so that a first portion of gas from the common gas source can pass into the drum chamber via the sweep gas inlet and serve as sweep gas; and the common gas source is in communication with the gap so that a second portion of gas from the common gas source can pass into the gap and serve as flush gas.

18. The apparatus of claim 5 wherein:

the tumbler drum wall comprises a first end wall, a second end wall, and a side wall that extends between the end walls and together with the end walls defines the drum chamber;

the sweep gas inlet extends through the first end wall and the sweep gas outlet extends through the second end wall;

the apparatus further comprises a dust collection assembly;

the exhaust duct is positioned between the dust collection assembly and the sweep gas outlet, the exhaust duct being in fluid communication with the dust collection assembly and the sweep gas outlet;

the polysilicon inlet is a port that extends through the side wall, the port being configured to provide access to the drum chamber for introducing the polysilicon material into the drum chamber and for removing the tumbled polysilicon material from the drum chamber; and at least a portion of the side wall, the first end wall, the second end wall, or a combination thereof has an interior surface that comprises quartz, silicon carbide, silicon nitride, silicon, or polyurethane.

19. The apparatus of claim 5 wherein the polysilicon inlet is the sweep gas inlet, with the source of sweep gas being in communication with the polysilicon inlet.

20. Apparatus for separating granular polysilicon and silicon powder, the apparatus comprising:

a tumbler drum comprising a drum wall that defines a drum chamber, a polysilicon inlet suitable for loading granular polysilicon into the drum chamber, a sweep gas inlet positioned to admit sweep gas into the drum chamber, and a sweep gas outlet positioned to discharge sweep gas from the drum chamber;

a stand that supports the tumbler drum for rotation about an axis of rotation;

an exhaust tube that is affixed to and extends outwardly from the drum wall, the exhaust tube having a proximal end, a distal end, and an inner wall surface that defines a proximal exhaust tube opening located at the proximal end, a distal exhaust tube opening located at the distal end, and an exhaust tube passageway that extends axially through the exhaust tube from the proximal exhaust tube opening to the distal exhaust tube opening, the exhaust tube passageway being in communication with the drum chamber via the sweep gas outlet and the proximal exhaust tube opening;

an exhaust duct, a least a portion of which extends into the exhaust tube passageway, the exhaust duct comprising a wall that has a proximal end, a distal end, an outer wall surface and an inner wall surface that defines an exhaust duct inlet at the proximal end, an exhaust duct outlet, and an exhaust duct passageway that extends axially through the exhaust duct from the exhaust duct inlet to the exhaust duct outlet, the exhaust duct inlet being positioned such that the exhaust duct passageway is in communication with drum chamber, the exhaust duct being located such that a gap is defined between a portion of the outer wall surface of the exhaust duct and a portion of the inner wall surface of the exhaust tube;

a common gas source, the common gas source being in communication with the sweep gas inlet so that a first portion of gas from the common gas source can pass into the drum chamber via the sweep gas inlet and serve as sweep gas and the common gas source being in communication with the gap so that a second portion of gas from the common gas source can pass into the gap and serve as flush gas; and a source of motive power operable to rotate the tumbler drum about the axis of rotation.

* * * * *